United States Patent [19]

Veenemans et al.

[11] Patent Number: 4,829,939

[45] Date of Patent: May 16, 1989

[54] COOLING SYSTEM FOR A TURBO-COMPRESSOR

[75] Inventors: Cornelis Veenemans, JP Asten; Jan J. Goossens, GD Mierlo, both of Netherlands

[73] Assignee: Volvo Car B.V., Helmond, Netherlands

[21] Appl. No.: 122,963

[22] Filed: Nov. 19, 1987

[30] Foreign Application Priority Data

Nov. 24, 1986 [NL] Netherlands ..... 8602971

[51] Int. Cl.[4] ..... F02B 39/00

[52] U.S. Cl. ..... 123/41.29; 123/41.31; 60/605.3

[58] Field of Search ..... 123/41.29, 41.31; 60/605.1, 605.3

[56] References Cited

U.S. PATENT DOCUMENTS

| | | | |
|---|---|---|---|
| 2,582,916 | 1/1952 | Taub | 60/13 |
| 3,134,371 | 5/1964 | Crooks | 123/41.31 |
| 3,827,236 | 8/1974 | Rust | 60/605.3 X |
| 4,385,594 | 5/1983 | Hauser, Jr. | 123/41.29 |
| 4,561,387 | 12/1985 | Körkemeier et al. | 123/41.31 |
| 4,608,827 | 9/1986 | Hasegawa et al. | 123/41.31 X |
| 4,620,509 | 11/1986 | Crofts | 123/41.31 X |
| 4,625,682 | 12/1986 | Dietrich et al. | 123/41.31 |

FOREIGN PATENT DOCUMENTS

| | | | |
|---|---|---|---|
| 743329 | 5/1943 | Fed. Rep. of Germany | 123/41.31 |
| 908930 | 4/1954 | Fed. Rep. of Germany . | |
| 2631121 | 1/1978 | Fed. Rep. of Germany . | |
| 3424580 | 11/1985 | Fed. Rep. of Germany . | |
| 2519694 | 7/1983 | France . | |
| 2559548 | 8/1985 | France . | |
| 0192828 | 10/1985 | Japan | 60/605.3 |
| 0222526 | 11/1985 | Japan | 60/605.3 |
| 6026193 | 12/1985 | Japan . | |

*Primary Examiner*—Tony M. Argenbright
*Assistant Examiner*—Eric R. Carlberg
*Attorney, Agent, or Firm*—Pennie & Edmonds

[57] ABSTRACT

A cooling system for the cylinder head, the inlet manifold and/or the bearings of a turbo-compressor of a combustion engine with a liquid cooling circuit with a radiator, a thermostat and an electric fan as well as a circuit for the cooling of said cylinder head, the inlet manifold wherein the cylinder head and/or the inlet manifold and/or the bearings of a turbo-compressor to be cooled are incorporated in a cirucit (11) which is connected in series or parallel to the part of the engine liquid cooling circuit (6) between the cylinder head of the engine block (1) and the radiator (7).

4 Claims, 1 Drawing Sheet

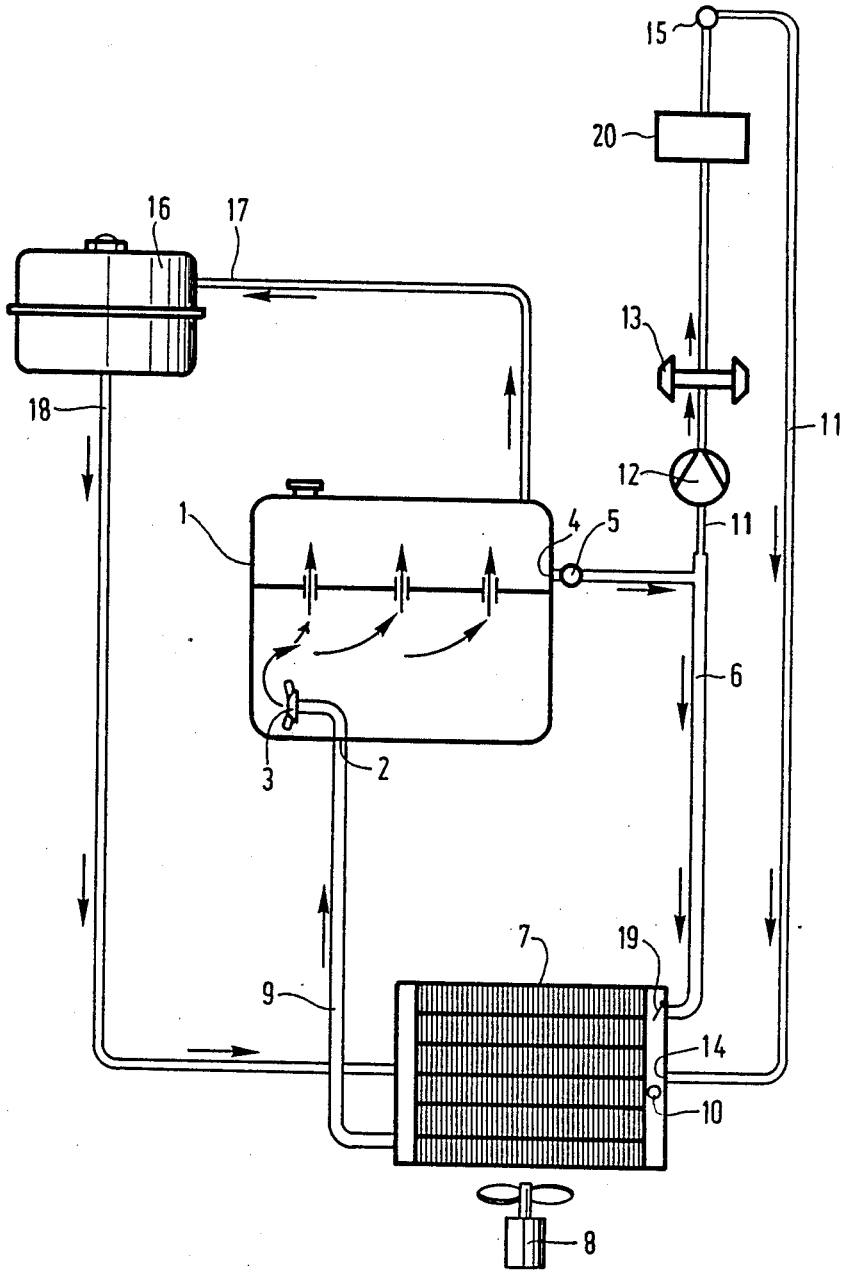
15
20
16
17
13
18
11
12
1
4
5
11
6
3
2
7
19
9
14
10
8

COOLING SYSTEM FOR A TURBO-COMPRESSOR

The invention relates to a cooling system for the cylinder head, the inlet manifold with injectors and/or the bearings of a turbo-compressor of a combustion engine with a liquid cooling circuit with a radiator, a thermostat and an electric fan and also provided with a circuit for cooling of the cylinder head, the inlet manifold with injectors and/or said bearings, provided with an electrically driven coolant pump.

The temperature in the cylinder head, the inlet manifold with the injectors and in the turbo-compressor bearings of turbo-engines rises very high after the engine has been switched off after a full load run. The temperature of the oil present in the bearings rises to over 250° C. Due to these high oil temperatures oil is burned, whereby burned oil residue is deposited in particles and forms a hard layer on vital parts, such as bearings and sealings (so-called coking). The gradual loss of cooling and lubricating properties of the partly burned oil and the increasing deposition of hard particles leads to damage to and failure of the turbo-compressor. Some manufacturers, therefore, prescribe that the engine should not be switched off immediately after a forced run, but should be kept running stationarily for approx. one minute.

The new generation of turbo-compressors is provided with a liquid cooled bearing house. Said bearing house is thereby incorporated in the cooling circuit of the engine. After the engine and the coolant pump have been switched off the bearing house is cooled, as is usual in a cooling system which operates according to the "thermosyphon" principle. In other cases the flow of liquid of the cooling system is maintained after the engine has been switched off by placing an electrically driven pump in the circuit to the expansion tank.

Both systems have disadvantages because of their still limited efficiency or reliability.

There is insufficient cooling of the engine. This leads to damage to the turbo-compressor and so-called "hot" starting problems both with engines with a turbo-compressor and with those without one because of a too high temperature of the fuel injectors. Because of the imperfect cooling after the engine has been switched off the temperature of the coolant flowing out of the cylinder head (approx. 110° C.) is again increased (approx. 130° C.) after passing through the turbo-bearings. The coolant is not led to the radiator then, but led back to the hot engine. In this manner the cooling off period takes very long. In the above-mentioned situation all coolant flows back through the fully opened thermostat to the cylinder block via the turbo. As the engine is not running there is only a thermosyphon action here, supplemented by the action of the electric pump possibly incorporated in the circuit.

According to the present invention the disadvantages are removed when the cylinder head, the inlet manifold with the injectors and/or the bearings of the turbo-compressor to be cooled are incorporated in a supplementary circuit which, dependent on the operating situation, is placed parallel or in series with the part of the engine coolant circuit between the cylinder head of the engine block and the radiator.

The coolant pump incorporated in the supplementary circuit is controlled by a temperature switch. At an entrance temperature of the liquid from the "turbo" of over 100° C. said electric pump is put into operation and that regardless whether the engine is runing or not. The coolant is sucked in behind the normally present and opened (open at 100° to 110° C.) thermostat from the engine cooling circuit at the cylinder head and pumped, via the "turbo", to the radiator, where the absorbed heat is given up to the surroundings. In the pipe part between turbo and radiator there is incorporated a thermo contact, which operates the electric fan of the radiator when the temperature of the coolant exceeds a certain value upon entering the radiator. A non-return valve in the connection between cylinder head and radiator, which is essential to the operation, prevents liquid from being sucked from the radiator instead of from the cylinder head.

The pump is switched off when the coolant temperature becomes lower than approx. 95° C. After the engine has been switched off, regardless of the exit temperature of coolant from the turbo, the pump is put into operation for 30 seconds.

The incorporation of the electrically driven coolant pump with control means, a non-return valve and a thermo contact of the control of the electric cooling fan in a circuit supplementing the usual cooling circuit guarantees the cooling of the cylinder head, the inlet manifold with injectors and the turbo under all circumstances so that extreme oil temperatures, causing damage, and "hot" starting problems are avoided.

The cooling system according to the invention can also be used for engines without a turbo-compressor. The cooling effect of the system has also an advantageous influence on the temperature of the cylinder head, the inlet manifold and the fuel injectors. Starting a "hot" engine will no longer present problems.

The invention will now be explained with reference to a drawing which diagrammatically illustrates the entire cooling system.

The figure diagrammatically illustrates an engine block 1, being fed to the engine block at 2 by means of a mechanical coolant pump 3 and being discharged from the cylinder head part at 4 via a thermostat 5. The liquid discharged is led to a radiator 7 via a hose 6, cooled in said radiator, with the aid of an electric fan 8 if desired and, having been cooled, led back to the engine block 1 again via hose 9. The fan 8 is switched on by a thermo contact 10, which is also set to the temperature to be allowed of the supplementary circuit to be described hereinafter.

According to the invention a supplementary circuit 11 is connected behind the thermostat 5, incorporated in which circuit are an electric coolant pump 12 and the turbo-compressor 13 to be cooled. The circuit 11 opens into the radiator at 14 near the thermo contact 10. In the circuit 11, behind (in the direction of flow) the turbo-compressor 13, there is incorporated a temperature switch 15 which puts the coolant pump 12 in the same circuit into action at approx. 100° C. and out of action at approx. 95° C.

For the sake of completeness the drawing also illustrates an expansion tank 16 with connecting pipes (hoses) 17 and 18.

Characteristic for the invention is the temperature switch 15, which co-operates with the electric coolant pump 12, whether the engine is runing or not. The same applies to the thermo contact 10, which also co-operates autonomously with the fan 8, with regard to the temperature of the coolant of both the engine and the turbo-compressor. Essential for the purpose aimed at, viz.

reducing the temperature level of the cylinder head, the inlet manifold with injectors 20 and the turbo bearings without the disadvantages mentioned, by quick cooling, is a non-return valve 19 preferably forming part of the radiator 7.

Essential in relation to the known state of the art is that positive use is made of the radiator (7), possibly aided by the fan (8) for the cooling of the cylinder head, the inlet manifold with injectors and the bearings of the turbo-compressor, whereby the non-return valve and the other means mentioned are indispensible. The supplementary circuit according to the invention is connected both parallel and in series to the normal cooling circuit. When the engine is running the circuit is parallel. With an opened thermostat the coolant flows partly direct to the radiator and partly via the supplementary circuit. With a switched-off engine there is a series circuit, because alle coolant flows via the supplementary circuit.

We claim:

1. A cooling system for a cylinder head of a combustion engine and for at least one of two means consisting of inlet manifold means with injectors and bearing means of a turbo-compressor, said cooling system having a liquid cooling circuit incorporating a circuit with a coolant pump for the cooling of said cylinder head, a thermostat and a radiator with an electric fan, the radiator being connected via a passage to said thermostat, and further incorporating a supplementary circuit with an electrically driven coolant pump and with at least one of said two means being connected to said electrically driven coolant pump, said supplementary circuit being connected mechanically parallel to said passage, said passage being provided with a non-return valve for preventing backflow of liquid through said passage when said electrically driven coolant pump is activated, and said supplementary circuit being connected to said thermostat situated upstream and to said radiator situated downstream for allowing cooling liquid to cool at least one of said two means, depending on the operating situation.

2. A cooling system for a cylinder head of a combustion engine and for at least one of two means consisting of inlet manifold means with injectors and bearing means of a turbo-compressor, said cooling system having a liquid cooling circuit incorporating a circuit with a coolant pump for the cooling of said cylinder head, a thermostat and a radiator with an electric fan, the radiator being connected via a passage to said thermostat, and further incorporating a supplementary circuit with an electrically driven coolant pump and with at least one of said two means being connected to said electrically driven coolant pump, and with a temperature switch, which puts said electrically driven coolant pump into operation at an exit temperature of the liquid from at least one of said two means of over approximately 100° C., said supplementary circuit being connected mechanically in parallel to said passage, said passage being provided with a non-return valve for preventing backflow of liquid through said passage when said electrically driven coolant pump is activated, and said supplementary circuit being connected upstream to said thermostat and downstream to said radiator for allowing cooling liquid to cool at least one of said two means, depending on the operating situation.

3. A cooling system according to claim 1 or 2, wherein there is incorporated in said radiator a thermocontact which can activate said electric fan of said radiator when the temperature of the coolant from the supplementary circuit exceeds a certain value on entering the radiator.

4. A cooling system according to claim 2, wherein said temperature switch is arranged to switch off the electrically driven coolant pump at a coolant temperature below approximately 95° C.

* * * * *